US005294243A

United States Patent [19]

Taft et al.

[11] Patent Number: 5,294,243

[45] Date of Patent: Mar. 15, 1994

[54] METHOD OF OPERATING COKELESS CUPOLA

[75] Inventors: Richard T. Taft, Worcestershire; David R. Edwards, Dudley, both of England; Reiner Graf, Hosbach, Fed. Rep. of Germany

[73] Assignee: Cokeless Cupolas Limited, Stourbridge, England

[21] Appl. No.: 29,873

[22] Filed: Mar. 11, 1993

[30] Foreign Application Priority Data

Sep. 12, 1990 [GB] United Kingdom ..... 9019894.6
Sep. 5, 1991 [WO] PCT Int'l Appl. ..... PCT/GB91/01510

[51] Int. Cl.[5] ..... C22B 11/00
[52] U.S. Cl. ..... 75/376; 75/574
[58] Field of Search ..... 75/376, 574, 575; 266/79, 201, 900

[56] References Cited

U.S. PATENT DOCUMENTS 3,802,678 4/1974 Taft et al. ..... 266/218
4,137,071 1/1979 Mrdjenovich ..... 75/30
4,896,810 1/1990 Maschlanka et al. ..... 266/900
4,925,489 5/1990 von Bogdandy et al. ..... 75/574

FOREIGN PATENT DOCUMENTS 1932162 1/1971 Fed. Rep. of Germany .
1239004 7/1971 Fed. Rep. of Germany .
2126142 10/1989 Fed. Rep. of Germany .

OTHER PUBLICATIONS

Giessert-vol. 66 No. 12, Jun. 11th 1979 Dusseldorf DE. pp. 415–417. No translation available.

*Primary Examiner*—Melvyn J. Andrews
*Attorney, Agent, or Firm*—Christensen, O'Connor, Johnson & Kindness

[57] ABSTRACT

The conventional operation of a cokeless cupola furnace has a requirement for a low volume of slag to be produced, because of the fact that there is no ash from coke to remove from the charge, and the fact that flux added to the charge to form slag eats away at the furnace lining, and at the bed of refractory spheres Running the furnace at low slag volumes makes the slag thick and can cause blockage of the slagging and tapping box. The invention adds more flux materials than is conventional, preferably including silica in the form of broken bottles, so as to deliberately increase the volume of slag, improving the flow. Care must be taken not to add too much slag-forming materials.

19 Claims, No Drawings

METHOD OF OPERATING COKELESS CUPOLA

This invention relates to metal-melting furnaces, in particular cokeless cupola furnaces, and is concerned with control of the slag.

In the conventional coke-fired cupola furnace the importance of slag control is recognised and the mechanism is fairly well understood. Typically there is between 8% and 10% of ash in the coke, and this must be removed by being converted into a suitable slag which is liquid at the temperature of the furnace and can flow out of a suitable tapping hole in the region of the well of the furnace. An additional function of the slag is to carry out with it any dirt charged into the furnace with the metallic charge, including any foundry sand still sticking to the 'returns'.

Additionally during melting some oxidation of the metal itself and of other components present may occur, and this likewise results in materials which must be absorbed into a suitable slag so that the furnace can be operated easily.

The primary function of the slag is therefore to absorb the ash in the coke and other impurities in the charge. In addition most cupola furnaces are lined with a refractory material and as this gradually wears away this material must also be absorbed into the slag. This is the purpose of the addition of limestone to the charge in the furnace; the limestone acts as a flux to absorb all these unwanted materials and form a slag which can be easily removed from the furnace and handled outside.

In a coke-fired cupola it is important that the carbon in the coke should be easily released from the coke so that it can act both as a fuel, generating the necessary heat, and as a source of carbon for the metal, primarily where the metal is iron or a ferrous alloy. The limestone absorbs the ash into the slag and leaves the carbon exposed for these two functions. It is sometimes necessary to add further materials such as a fluorspar which makes the slag more reactive to the ash so that both better carbon pick-up and better temperatures in the furnace can be obtained.

Tapping temperatures in a coke-fired cupola furnace are generally around 1500° C. or even higher, and at these temperatures the slag is quite fluid; lower tapping temperatures are not generally employed in a coke-fired furnace as otherwise problems result both from carbon pick-up and from poor overall cupola performance.

The whole question of fluxing agents is not so well understood, nor its importance appreciated, in cokeless cupolas. We have discovered that slag control is essential to the correct operation of a cokeless cupola as opposed to being of minor importance as was previously felt.

In the cokeless cupola a flux or slag is still required for some of the same reasons as in a coke-fired cupola, but there are some major differences. There is no ash to flux, so one of the main reasons for adding a flux has been eliminated. However there is still dirt in the charge and sand sticking to the returns, and so these materials still have to be converted into a fluid slag. The oxidation losses are lower than in a coke-fired furnaces so again, from this aspect, less flux is required. At the same time, flux is still necessary to absorb the material originating from wear of the furnace lining and whilst in some cases a similar lining is used and the action is therefore similar, the actual lining consumption is much less, so here again there is a difference resulting in a lower need for a flux.

Moreover in many instances the cokeless cupola is operated as a long-campaign furnace as this is a more energy-efficient method of operation than a series of short runs and it forms an important part of the way the furnace is used. In this case high-alumina linings are often employed and this alumina has to be absorbed into the slag as the lining wears. This too points to using as little fluxing agent as possible so as to produce the minimum of slag.

We have discovered that the question of slag control is of surprising importance.

According to a first aspect the invention consists in a method of operating a cokeless cupola metal-melting furnace, the furnace being a kind in which the charge is supported on a bed of heat-exchange bodies of a predominantly silica, alumina composition, comprises the steps of continually monitoring the composition and viscosity of the emerging slag and, as a consequence of the information obtained, adjusting the composition of the slag-forming fluxing agents which are incorporated in the charge along with the metal, the fluxing agents comprising largely limestone and/or dollastone and the adjustment being at least partially obtained by additions of glass or gravel or other silica-containing materials to alter the volume and viscosity of the resulting slag so as to keep them just sufficiently low to ensure continuous flow of the slag from the top of the bed of heat exchange bodies down through the bed, and at the same time ensuring that the minimum amount of fluxing agents necessary to achieve this result are added to as to minimise consumption of the heat-exchange bodies.

At present in the rare occasions that the operator of a cokeless cupola considers how much fluxing agent to add his instinct from working with coke cupolas (where the precise amount of fluxing agent does not matter - so long as there is enough) is to shovel on a lot of fluxing agent, and then shovel on another few shovelfulls for luck. This normally results in excessive consumption of the heat-exchange bodies.

The lower slag volume that results in the operation of the cokeless cupola is not a problem in intermittent tapping and is certainly an advantage for slag disposal. However, with continuous tapping we have found that this low slag volume can cause operational problems as the slag does not flow continuously from the front tapping and slagging box. This means that an operator continually has to release the slag by breaking the crust on the top of the box with a suitable bar, which is hot and heavy work.

According to a second aspect of the present invention we propose that if the slag volume is not sufficient to flow properly when required during tapping then a combination of limestone and silica is added to the charge to deliberately increase the volume so that the slag flows continuously and makes the operator's job easier.

This slag volume would then in many circumstances be similar to that in a conventional coke cupola.

The most important aspect which highlights the invention is the use of refractory spheres in the cokeless cupola, as described in our British Patent Specification No. 1 326 884 dated 1972 (the contents of which are hereby incorporated by reference) and in various published papers. These spheres form an essential part of the operation, both technically and economically. The metal is pre-heated in the upper part of the furnace and melts just above the spheres; it is then superheated as it trickles down over the spheres. The depth of the bed of spheres governs the amount of superheat and therefore the tapping temperature. The flux additions must also melt above the bed and these additions are likewise superheated in passing down over the spheres. However, we have appreciated that the types of flux materials generally employed in order to produce a fluid slag also attack the spheres, and that it is very important to control the addition of fluxing agents.

Generally limestone or dollastone is used as the fluxing material, or sometimes a mixture of the two.

If insufficient fluxing agents are added, the result is a slag which is viscous rather than fluid, and it does not flow easily through the spheres. Instead it tends to be held above them and it then builds up in a layer above the spheres. This can reach the point where, in a bad condition, the slag can be blown back up the furnace shaft, causing severe operational difficulties and in the worst case the melting of the metal ceases altogether as the metallic charge becomes coated with the viscous slag. Thus with insufficient fluxing agents the furnace does not produce any metal at all.

On the other hand, although we propose to add more fluxing material than is conventional, if too much fluxing material is added, with a view to keeping the slag fluid, the spheres will be attacked by the fluxing materials, leading to a high consumption of spheres which not only increases the operating cost but also, because of the reduced thickness of the bed as the spheres are consumed, leads to problems of insufficient superheating of the metal and consequently low tapping temperatures. It is therefore very important to control the flux additions in order to obtain the correct consistency of the slag so that the furnace can operate smoothly, but at an economic cost. This control may involve deliberately increasing the volume of slag by suitable additions in order to operate a continuously tapped furnace smoothly.

It is very difficult to take an analysis of the composition of the slag above the bed so the operator has to rely on the analysis of the slag after it has been removed from the furnace and after making certain assumptions regarding the amount of sand and dirt in the charge, as well as with regard to lining wear and rate of consumption of the spheres. With these assumptions he can then calculate what changes must be made to the flux addition in order to obtain a fluid slag at the required tapping temperatures, yet, importantly, with minimum adverse effect on the spheres.

It is obvious, therefore, that the required quantity and composition of the flux addition will vary for each operation of the cupola, the variables being the make-up of the charge, the type of lining, and the tapping temperature which will then govern the rate of consumption of the spheres. The flux addition will also depend on whether the furnace is to be tapped intermittently in which case a relatively low volume of slag can be handled, or is to be continuously tapped, in which case a higher slag volume is necessary for smooth operation.

It is not possible to achieve zero sphere consumption, but we have discovered that there is an optimum consumption for different modes of operation. If high tapping temperatures are required (about 1500° C.) the acceptable sphere consumption can be as much as 2½% to 3%, or even 3½%. At low tapping temperatures when a duplex operation is being performed (about 1400° C.) to give the best economical method of melting the iron, the acceptable sphere consumption is around 1%.

A range of consumption of between ¾% and 1½% is also reasonably economic. The spheres in a typical cokeless furnace have a composition of approximately 45% silica, 35% alumina and 20% carbon and hence when these dissolve they obviously influence the composition of the slag.

A typical slag analysis would have a composition in the following range:

| | |
|---|---|
| Silica: | 40%-50% |
| Lime plus magnesia: | 25%-35% |
| Alumina: | 10%-20% |
| Iron oxides: | less than 10% |

Other oxides, such as manganese, titanium, sodium and potassium all add up to less than 5%.

Broadly speaking, therefore, the invention is based on an appreciation of the importance of slag control in the operation of a cokeless cupola furnace with the minimum of trouble, in particular without problems originating from a slag which is too viscous, yet at minimum cost, that is to say, low sphere consumption and low lining wear.

According to another aspect of the invention a method of operating a cokeless cupola metal-melting furnace on a continuous or intermittent basis, the furnace being a kind in which the charge is supported on a bed of heat-exchange bodies of a predominantly silica, alumina composition, comprises the steps of continually monitoring the composition and viscosity of the emerging slag and, as a consequence of the information obtained, adjusting the composition of the slag-forming fluxing agents which are incorporated in the charge along with the metal, the fluxing agents comprising largely limestone and/or dollastone and the adjustment being at least partially obtained by additions of glass or gravel or other silica-containing materials to alter the viscosity and/or volume of the resulting slag and keep it just sufficiently low to ensure easy flow of the slag from the furnace during tapping.

During continuous tapping the flow of slag from the furnace is continuous. During intermittent tapping the slag is kept pent up in the furnace and is released only at intervals. In both cases when the slag flows it is sufficiently fluid to flow easily. This avoids handling difficulties.

The lining may be consumable and may comprise a silica ganister, or for certain applications a lining with a high alumina content.

In particular where the lining of the furnace has a significant alumina content problems of excessive viscosity in the slag are almost certain unless steps are taken to adjust the composition of the flux accordingly, primarily by the addition of lime and magnesia, but where these are already at an acceptable level, scrap glass or gravel or other predominantly silica-containing materials must be added; generally speaking a high alumina content, whether from the incoming charge, the furnace lining or the spheres, will cause a high viscosity high melting-point slag unless counteracted by the measures described.

Even where the metallic charge is known to be of pure metal free from dirt and sand, it is still essential to add fluxing agents to form a slag, if only to absorb the products of lining wear and sphere consumption.

Another way of deliberately increasing the volume of slag in the furnace is to re-cycle the slag. Slag may be removed from the furnace, broken up into appropriately sized pieces, and a proportion of it re-introduced into the furnace as a component of the fluxing materials (the other component being limestone and/or dollastone or the like).

It is of course known, and indeed normal, to adjust the composition of the incoming fluxing agents in the charge in a coke-fired cupola in order to keep the slag fluid; however in coke-fired cupolas this is no problem and simply involves the addition of more limestone because there is no heat-exchange bed to worry about. Anyway in a coke-fired cupola the tapping temperature is higher, which means that if the slag composition is not quite right the extra temperature will still enable the slag to be removed quite easily. If more limestone were to be added in a cokeless cupola to maintain fluidity it would increase greatly the rate of consumption of the spheres, increasing the overall running costs as well as shortening the length of melting run that is possible. Moreover, in a cokeless cupola slag control is much more critical because of the lower temperatures.

Some examples will now be described to illustrate what can happen when a cokeless cupola is not run in accordance with the invention. The examples show the importance of slag control.

EXAMPLE I

In a cokeless cupola lined with a high alumina material, and operated for one week without repair although melting on only a single shift, the quantity of dollastone added to take care of the dirt, and the products of wear on the spheres and the wear on the lining was of the order of 2 to 2.5% of the charge by weight. It was found that the slag did not flow continuously and the operators had great difficulty in repeatedly opening the box to remove the slag. The melting point of the slag was barely higher than the tapping temperature and so with a small stream of slag the stream tended freeze off altogether and had to be re-started.

If the operators failed to clear the slag box at regular intervals the slag built up within the furnace to a point where it approached the area of the burners and was agitated into a foam which could rapidly increase in height and block the burners.

The addition of flux was therefore increased to between 5% and 6%, maintaining the normal make-up of around 3% to 3½% of mixed limestone and dollastone together with 1% to 2% of silica in the form of broken bottles and, depending on the slag condition, some iron oxide.

The combination had a similar composition to what had been used previously, i.e. there was no change in its melting point or viscosity, but simply the increase in slag volume meant that the slag flowed continuously and the job of the operators was made very much easier.

This example shows, amongst other things, the importance of the slag having sufficient volume to flow during tapping, especially during continuous tapping.

EXAMPLE II

A cokeless cupola operating with a clean charge and with what were mistakenly thought to be correct proportions in the charge including 12 Kg of dollastone per charge was found to exhibit very rapid consumption of the spheres, with the consequence that the bed almost vanished by the end of an eight-hour shift, resulting in insufficient superheating and low metal temperature.

The amount of dollastone was reduced to 8 Kg per charge, representing about 1½% of the charge by weight, and the result was an immediate reduction in the consumption of spheres so that at the end of the campaign there was still a bed over 45 cm thick and good metal temperatures were obtained. Thus by using 50% too much dollastone flux material in the initial run there was too much consumption of the refractory spheres in the bed. This just goes to show that the "obvious" way of increasing slag volume - shovelling on several more shovels of limestone than is needed for our optimum method of operation results in excessive consumption of the spheres and subsequent decrease in the bed height and operational performance of the furnace.

We have discovered that running the furnace at higher temperatures (1500° C.) increases the consumption of the bed to around 3%, even with the correct flux charge (it was 4% with the wrong flux charge).

EXAMPLE III

A cokeless cupola furnace with a high alumina lining used slag-forming additions in the form of 2% of a mixture of limestone and dollastone. Difficulties arose through bridging of the metal, and the slag was very sticky. It was observed that the metal in the charge included a high proportion of 'returns' which were coated with a significant amount of silica in the form of a foundry sand.

The combined addition of dollastone and limestone, in the same proportions as before, was increased to 5%. Immediately the slag flowed with good fluidity and the bridging problem disappeared. The bridging was found to have been due to the sticky slag being thrown back up the shaft and coating the charge.

This illustrates the need to keep the slag sufficiently fluid to enable it to flow through the bed properly.

We claim:

1. A method of operating a cokeless cupola metal-melting furnace, the furnace being a kind in which the charge is supported on a bed of heat-exchange bodies of a predominantly silica, alumina composition, comprising the steps of continually monitoring the composition and viscosity of the emerging slag and, as a consequence of the information obtained, adjusting the composition of the slag-forming fluxing agents which are incorporated in the charge along with the metal, the fluxing agents comprising largely limestone and/or dollastone and the adjustment being at least partially obtained by additions of glass or gravel or other silica-containing materials to alter the viscosity and/or volume of the resulting slag so as to keep them just sufficiently low to ensure continuous flow of the slag from the top of the bed of heat-exchange bodies down through the bed, and at the same time ensuring that the minimum amount of fluxing agents necessary to achieve this result are added so as to minimise consumption of the heat exchange bodies.

2. A method according to claim 1 which further comprises the step of re-cycling slag removed from the furnace by re-introducing at least a portion of the slag as a component of the slag-forming fluxing agents.

3. A method according to claim 2 wherein limestone, dollastone is added to the re-cycled slag as another component of the fluxing agents.

4. A method according to claim 1 wherein sufficient flux materials are added to the melt to keep the viscosity of the slag below a critical value at which point the slag tends to be held above the heat-exchange bodies and has difficulty in flowing through the bed.

5. A method according to claim 1 wherein the rate of consumption of the heat-exchange bodies is between ¾% and 1½% of their weight.

6. A method according to claim 1 wherein silica is added to the charge as a fluxing agent.

7. A method according to claim 6 wherein the silica comprises broken bottles, jars, gravel.

8. A method according to claim 1 wherein the proportion of said fluxing agents in the charge is between about 5% and 6% by weight.

9. A method according to claim 1 wherein the fluxing agents include about 1% to 2% silica in the form of broken glass.

10. A method according to claim 1 wherein the furnace has a furnace lining which has a high alumina content.

11. A method of operating a cokeless cupola metal-melting furnace, the furnace being a kind in which the charge is supported on a bed of heat-exchange bodies of a predominantly silica, alumina composition, comprising the steps of continually monitoring the composition and viscosity of the emerging slag and, as a consequence of the information obtained, adjusting the composition of the slag-forming fluxing agents which are incorporated in the charge along with the metal, the fluxing agents comprising largely limestone and/or dollastone and the adjustment being at least partially obtained by additions of glass or gravel or other silica-containing materials to alter the viscosity and/or volume of the resulting slag and keep it just sufficiently low to ensure continuous flow of the slag from the furnace during tapping.

12. A method according to claim 11 which further comprises the step of re-cycling slag removed from the furnace by re-introducing at least a portion of the slag as a component of the slag-forming fluxing agents.

13. A method according to claim 12 wherein limestone, dollastone is added to the re-cycled slag as another component of the fluxing agents.

14. A method according to claim 11 wherein sufficient flux materials are added to the melt to keep the viscosity of the slag below a critical value at which point the slag tends to be held above the heat-exchange bodies and has difficulty in flowing through the bed.

15. A method according to claim 11 wherein the rate of consumption of the heat-exchange bodies is between ¾% and 1½% of their weight.

16. A method according to claim 11 wherein silica is added to the charge as a fluxing agent.

17. A method according to claim 16 wherein the silica comprises broken bottles, jars, gravel.

18. A method according to claim 11 wherein the proportion of said fluxing agents in the charge is between about 5% and 6% by weight.

19. A method according to claim 11 wherein the fluxing agents include about 1% to 2% silica in the form of broken glass.

* * * * *

UNITED STATES PATENT AND TRADEMARK OFFICE

CERTIFICATE OF CORRECTION

PATENT NO. : 5,294,243

DATED : March 15, 1994

INVENTOR(S) : Richard T. Taft et al

It is certified that error appears in the above-indentified patent and that said Letters Patent is hereby corrected as shown below:

On the title page, add the following information:
- - [63] Continuation of PCT/GB91/01510, filed Sep. 5, 1991-- and under item [30], delete "Sep. 5, 1991 [WO] PCT Int'l Appl. .....PCT/GB91/01510"

Column 1, line 3, insert --This patent application is a continuing application claiming foreign priority benefits and claims for benefit of the filing date of international application No. PCT/GB91/01510, filed September 5, 1991.--

Signed and Sealed this

Seventeenth Day of October, 1995

*Attest:*

*Attesting Officer*

Bruce Lehman

BRUCE LEHMAN

*Commissioner of Patents and Trademarks*